US011164520B2

(12) United States Patent
Tsuge

(10) Patent No.: US 11,164,520 B2
(45) **Date of Patent: *Nov. 2, 2021**

(54) POWER OFF METHOD OF DISPLAY DEVICE, AND DISPLAY DEVICE

(71) Applicant: JOLED INC., Tokyo (JP)

(72) Inventor: Hitoshi Tsuge, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/600,149

(22) Filed: Oct. 11, 2019

(65) Prior Publication Data

US 2020/0043411 A1 Feb. 6, 2020

Related U.S. Application Data

(63) Continuation of application No. 15/032,133, filed as application No. PCT/JP2014/003887 on Jul. 23, 2014, now Pat. No. 10,482,813.

(30) Foreign Application Priority Data

Oct. 30, 2013 (JP) ..... 2013-226009

(51) Int. Cl.
*G09G 3/3233* (2016.01)
*G09G 3/325* (2016.01)
(Continued)

(52) U.S. Cl.
CPC ..... *G09G 3/3233* (2013.01); *G09G 3/325* (2013.01); *G09G 3/3266* (2013.01);
(Continued)

(58) Field of Classification Search
CPC .... G09G 3/3233; G09G 3/325; G09G 3/3266; G09G 3/3283; G09G 2300/0809;
(Continued)

(56) References Cited

U.S. PATENT DOCUMENTS 6,583,775 B1 6/2003 Sekiya et al.
8,228,271 B2 7/2012 Hirai et al.
(Continued)

FOREIGN PATENT DOCUMENTS

JP 2001-060076 3/2001
JP 2009-104104 5/2009
(Continued)

OTHER PUBLICATIONS

Fujii et al., "Thermal Analysis of Degradation in $Ga_2O_3$-$In_2O_3$-ZnO Thin-Film Transistors", Japanese Journal of Applied Physics, vol. 47, No. 8, 2008, pp. 6236-6240.
(Continued)

*Primary Examiner* — Patrick N Edouard
*Assistant Examiner* — Eboni N Giles
(74) *Attorney, Agent, or Firm* — Greenblum & Bernstein, P.L.C.

(57) ABSTRACT

A light emitting display panel includes a plurality of pixel circuits arranged in a matrix. Each of the plurality of pixel circuits includes a light emitting element, a capacitor that is connected to a gate of a drive transistor and the light emitting element, a first switch transistor that is connected to a first electrode of the capacitor, a first wire that is connected to the first electrode of the capacitor via the first switch transistor, a second switch transistor that is connected to a second electrode of the capacitor and the light emitting element, and a second wire that is connected to the second electrode of the capacitor via the second switch transistor. A voltage of the first wire and a voltage of the second wire are the same during a power off operation or during a non-light emission period.

9 Claims, 5 Drawing Sheets

(51) Int. Cl.
*G09G 3/3266* (2016.01)
*G09G 3/3283* (2016.01)

(52) U.S. Cl.
CPC ... *G09G 3/3283* (2013.01); *G09G 2300/0809* (2013.01); *G09G 2300/0819* (2013.01); *G09G 2300/0842* (2013.01); *G09G 2300/0861* (2013.01); *G09G 2310/0251* (2013.01); *G09G 2310/0278* (2013.01); *G09G 2330/02* (2013.01); *G09G 2330/027* (2013.01)

(58) Field of Classification Search
CPC ... G09G 2300/0819; G09G 2300/0842; G09G 2300/0861; G09G 2310/0251; G09G 2310/0278; G09G 2330/02; G09G 2330/027
See application file for complete search history.

(56) References Cited

U.S. PATENT DOCUMENTS

| | | | | |
|---|---|---|---|---|
| 8,289,244 | B2 | 10/2012 | Hasumi et al. | |
| 8,416,158 | B2 | 4/2013 | Seto | |
| 8,907,876 | B2 | 12/2014 | Hasumi et al. | |
| 9,117,409 | B2 | 8/2015 | Koyama | |
| 2003/0218593 | A1* | 11/2003 | Inoue | G09G 3/3655 345/92 |
| 2005/0280613 | A1 | 12/2005 | Takei et al. | |
| 2007/0080906 | A1 | 4/2007 | Tanabe | |
| 2008/0007547 | A1 | 1/2008 | Hasumi et al. | |
| 2010/0013746 | A1 | 1/2010 | Seto | |
| 2010/0073265 | A1 | 3/2010 | Hirai et al. | |
| 2013/0002637 | A1 | 1/2013 | Hasumi et al. | |
| 2013/0241431 | A1 | 9/2013 | Toyotaka et al. | |
| 2013/0241965 | A1* | 9/2013 | Koyama | G09G 3/3406 345/690 |
| 2014/0022150 | A1* | 1/2014 | Guo | G09G 3/3233 345/76 |
| 2014/0111567 | A1* | 4/2014 | Nathan | G09G 3/3233 345/694 |
| 2014/0176516 | A1* | 6/2014 | Kim | G09G 3/3233 345/204 |
| 2015/0206477 | A1 | 7/2015 | Xu | |
| 2015/0206498 | A1 | 7/2015 | Miyata et al. | |

FOREIGN PATENT DOCUMENTS

| | | |
|---|---|---|
| JP | 2009-271333 | 11/2009 |
| JP | 2010-025967 | 2/2010 |
| JP | 2013-218311 | 10/2013 |
| WO | 2005/034072 | 4/2005 |
| WO | 2006/070833 | 7/2006 |
| WO | 2013/137014 | 9/2013 |

OTHER PUBLICATIONS

International Search Report in International Patent Application No. PCT/JP2014/003887, dated Oct. 28, 2014.
U.S. Appl. No. 15/032,147 to Hitoshi Tsuge, filed Apr. 26, 2016.

* cited by examiner

POWER OFF METHOD OF DISPLAY DEVICE, AND DISPLAY DEVICE

CROSS REFERENCE PARAGRAPH

The present application is a Continuation of U.S. application Ser. No. 15/032,133, filed Apr. 26, 2016, which is a National stage of International Patent Application No. PCT/JP2014/003887, filed Jul. 23, 2014, which claims priority to Japanese Application No. 2013-226009, filed Oct. 30, 2013. The entire disclosure of each of these applications is expressly incorporated by reference herein in its entirety.

TECHNICAL FIELD

The disclosure relates to a power off method of a display device and to a display device. The disclosure particularly relates to a power off method of a display device that uses light emitting elements which emit light according to current, and to such a display device.

BACKGROUND ART

Organic EL displays utilizing organic electroluminescence (EL) have attracted attention in recent years, as a next-generation flat panel display to replace liquid crystal displays. Active matrix display devices such as organic EL displays use thin film transistors (TFTs) as drive transistors.

Patent Literature (PTL) 1 describes temporal characteristics shifts associated with thin film transistors.

PTL 2 describes a technique of preventing a display defect of a display device by providing a transistor for controlling whether or not to electrically connect the gate and source of a drive transistor included in each pixel.

CITATION LIST

Patent Literature

[PTL 1]
Japanese Unexamined Patent Application Publication No. 2009-104104
[PTL 2]
Japanese Unexamined Patent Application Publication No. 2013-218311

SUMMARY OF INVENTION

Technical Problem

In an oxide thin film transistor, the threshold voltage (gate-source voltage upon a transition between on and off) tends to shift due to electrical stress by the passage of current or the like. Such a temporal shift of the threshold voltage causes the amount of current supplied to an organic EL light emitting element to vary, thus affecting the luminance control of the display device and creating a problem of display quality degradation.

In view of the problem stated above, the disclosure provides a power off method of a display device and a display device that can prevent the threshold voltage shift of each drive transistor.

Solution to Problem

To solve the stated problem, a power off method of a display device according to the disclosure is a power off method of a display device that includes a display panel having a plurality of pixel circuits arranged in a matrix. Each of the plurality of pixel circuits includes: a light emitting element that emits light according to an amount of current supplied; a drive transistor that supplies the current to the light emitting element; and a capacitance element that is connected to a gate of the drive transistor and holds a voltage representing luminance. The power off method of a display device includes: detecting a power off operation on the display device; setting, when the power off operation is detected, a same potential in one electrode and an other electrode of the capacitance element in each of the plurality of pixel circuits; and stopping power supply to the display panel immediately after the same potential is set.

A display device according to the disclosure is a display device including a display panel having a plurality of pixel circuits arranged in a matrix. Each of the plurality of pixel circuits includes: a light emitting element that emits light according to an amount of current supplied; a drive transistor that supplies the current to the light emitting element; and a capacitance element that is connected to a gate of the drive transistor and holds a voltage representing luminance. The display device includes: a control unit that sets, when a power off operation is detected, a same potential in one electrode and an other electrode of the capacitance element in each of the plurality of pixel circuits; and a power unit that stops power supply to the display panel immediately after a specific process is completed.

Advantageous Effects of Invention

With the power off method of a display device and the display device according to the disclosure, the threshold voltage shift of each drive transistor in the period during which the power of the display device is off can be prevented.

DESCRIPTION OF EMBODIMENTS

Figure 1:
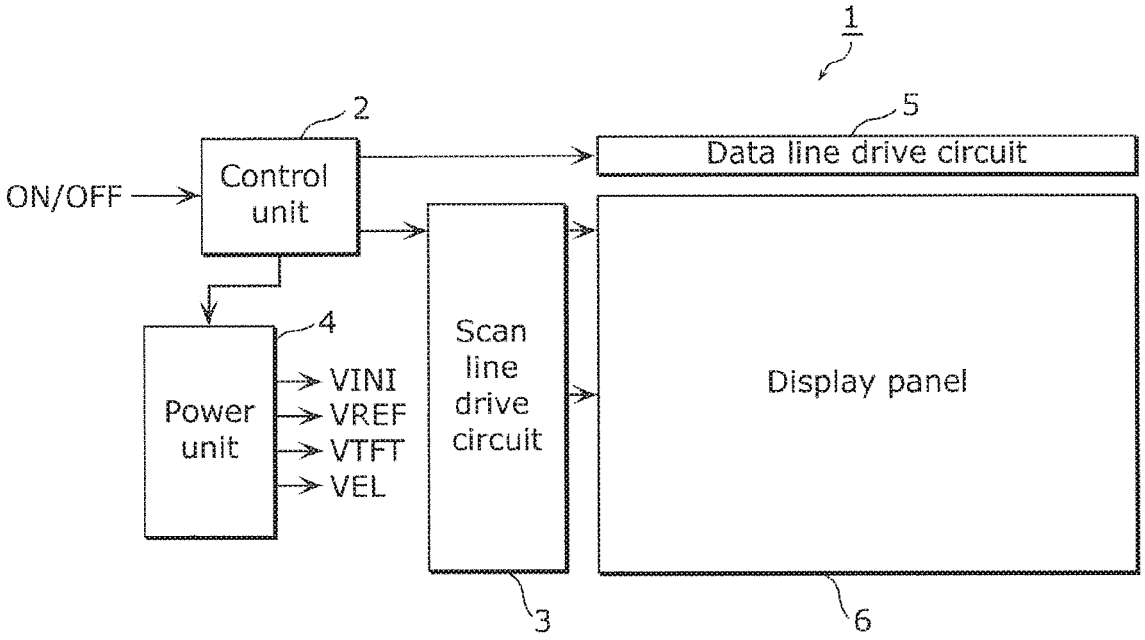
FIG. 1 is a block diagram illustrating an example of the structure of a display device according to an embodiment.

[Underlying Knowledge Forming Basis of the Disclosure]

Before the detailed description of the disclosed technique, underlying knowledge forming the basis of the disclosure is explained below.

Typically, a thin film transistor has high electron mobility, and is used as a drive transistor in each pixel of an active matrix display device. Each pixel of the display device includes a capacitance element that holds a voltage representing luminance, and the capacitance element is connected to the gate of the drive transistor. When the voltage representing luminance is applied to the gate of the drive transistor, the drive transistor supplies the current corresponding to the luminance value to an organic EL element (light emitting element). When supplied with the current, the light emitting element emits the amount of light corresponding to the current value.

An oxide thin film transistor used as such a drive transistor is advantageous in that it has very low leakage current during power off, and the magnitude of the leakage current is of the order of pA.

The inventors of the present application have found the following problem with regard to this very low leakage current. Since the leakage current is very low, even after the display device is powered off, the voltage representing the luminance immediately before the power off may be held in each pixel for several days, and applied to the drive transistor. This puts electrical stress on the drive transistor for several days despite the power of the display device being off, and causes its threshold voltage to shift.

There is thus a problem in that the threshold voltage of the drive transistor shifts even when the power of the organic EL display device is off. The threshold voltage shift differs depending on the type of oxide thin film transistor. For example, when the positive bias stress between the gate and the source is greater, the threshold voltage shifts more to the positive side.

Since the threshold voltage shifts differently depending on the display pattern immediately before power off, variations in threshold voltage shift amount among different pixels increase, which degrades image quality.

This degradation can be reduced, for example, by providing a transistor for controlling whether or not to electrically connect the gate and source of a drive transistor included in each pixel as in PTL 2. However, the provision of such a transistor has the following problem: During normal display, the gate capacitance of the transistor causes a decrease in bootstrap efficiency (a decrease in threshold voltage compensation ratio of the drive transistor), which leads to lower display performance.

Based on such knowledge, a power off method of a display device according to the disclosure sets, when a power off operation on the display device is detected, a voltage for suppressing electrical stress on a drive transistor, and stops power supply to the display panel immediately after the voltage is set. The voltage for suppressing electrical stress is actually 0 V, and the source or drain of the drive transistor is set to the same potential as the gate of the drive transistor. Given that the threshold voltage shift is more noticeable when the positive bias stress between the gate and the source is greater as mentioned earlier, electrical stress on the drive transistor is suppressed by creating a state in which a voltage representing black level is applied to the gate of the drive transistor. In addition, variations in drive transistor threshold voltage shift among pixels are suppressed.

In this way, electrical stress on the drive transistor is suppressed during power off of the display device, with it being possible to prevent the threshold voltage shift of the drive transistor.

The following describes embodiments in detail with reference to drawings.

Each of the embodiments described below shows a general or specific example. The numerical values, shapes, materials, structural elements, the arrangement and connection of the structural elements, steps, the processing order of the steps etc. shown in the following embodiments are mere examples, and do not limit the scope of the disclosure. Of the structural elements in the embodiments described below, the structural elements not recited in any one of the independent claims representing the broadest concepts are described as optional structural elements.

Embodiment

A power off method of a display device and a display device according to the disclosure are described below, with reference to drawings.

[1-1. Structure of Display Device]

Figure 2:
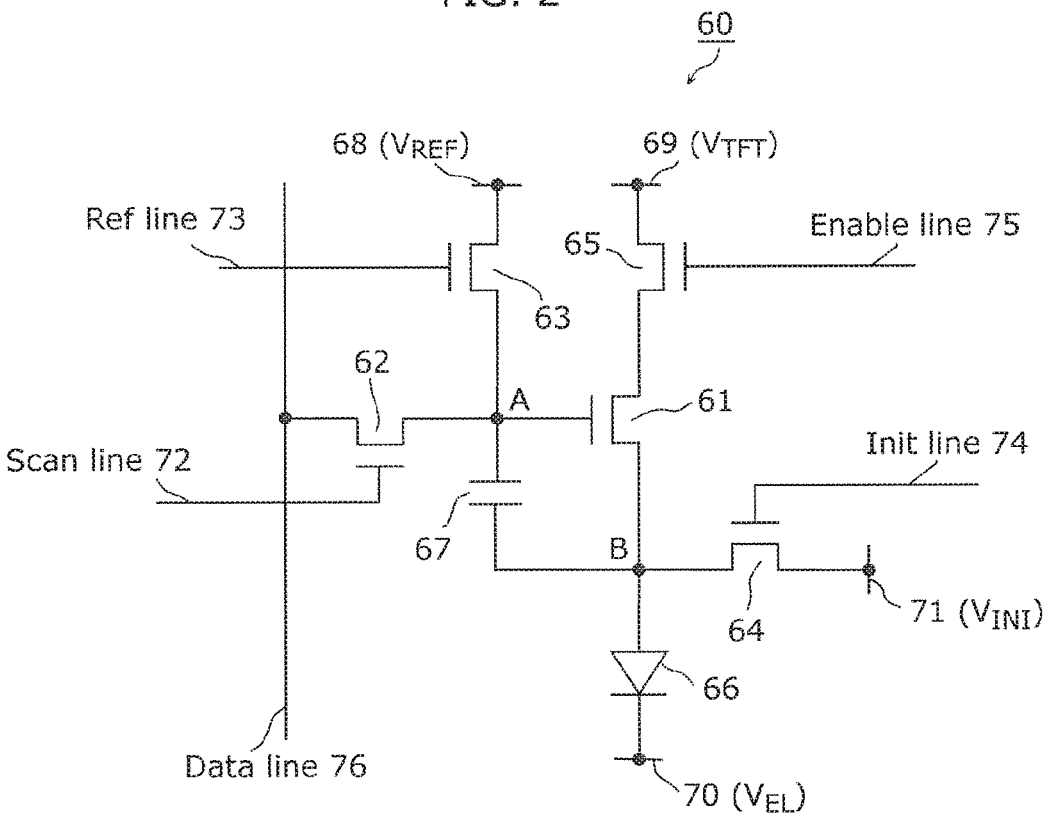
FIG. 2 is a circuit diagram illustrating an example of the structure of one of a plurality of pixel circuits arranged two-dimensionally in the display panel in FIG. 1 according to the embodiment.

This embodiment describes the case where organic EL elements are used as light emitting elements in a display device according to an aspect of the disclosure, with reference to FIGS. 1 and 2.

FIG. 1 is a block diagram illustrating an example of the structure of the display device according to the embodiment. FIG. 2 is a circuit diagram illustrating an example of the structure of one of a plurality of pixel circuits arranged two-dimensionally in the display panel in FIG. 1.

A display device 1 in FIG. 1 includes a control unit 2, a scan line drive circuit 3, a power unit 4, a data line drive circuit 5, and a display panel 6.

The display panel 6 is, for example, an organic EL panel. The display panel 6 includes N (e.g. N=1080) scan lines and N lighting control lines in parallel with each other, and M source signal lines orthogonal to the N scan lines and N lighting control lines. The display panel 6 also includes pixel circuits each including a thin film transistor and an EL element, at the respective intersections of the source signal lines and scan lines. Pixel circuits corresponding to the same scan line are hereafter referred to as "display line" according to need. In other words, N display lines each of which has M EL elements are arranged in the display panel 6.

The control unit 2 controls the frame--by-frame operation in normal display when the power of the display device is on, and controls the off sequence operation when a power off operation is detected. One of the features of the disclosure is that, when a power off operation on the display device is detected, the control unit 2 shifts control from the normal display operation to the off sequence operation. In the off sequence, the control unit 2 sets the same potential in one electrode and the other electrode of the capacitance element in each of the plurality of pixel circuits, to suppress electrical stress on the drive transistor in the pixel circuit. This potential may be ground level (0 V). The control unit 2 controls the power unit 4 to stop power supply to the display panel 6 immediately after the voltage is set.

In the normal display, the control unit 2 generates a first control signal for controlling the data line drive circuit 5 based on a display data signal, and outputs the generated first control signal to the data line drive circuit 5. The control unit 2 also generates a second control signal for controlling the scan line drive circuit 3 based on an input synchronization signal, and outputs the generated second control signal to the scan line drive circuit 3.

The display data signal mentioned here represents display data, and includes a video signal, a vertical synchronization signal, and a horizontal synchronization signal. The video signal is a signal for designating each pixel value as gray level information, for each frame. The vertical synchronization signal is a signal for synchronizing vertical screen processing, and serves here as a reference signal for processing timing of each frame. The horizontal synchronization signal is a signal for synchronizing horizontal screen processing, and serves here as a reference signal for processing timing of each display line.

The first control signal includes the video signal and the horizontal synchronization signal. The second control signal includes the vertical synchronization signal and the horizontal synchronization signal.

The power unit 4 supplies power to each of the control unit 2, the scan line drive circuit 3, and the display panel 6, and also supplies various voltages to the display panel 6. The various voltages are $V_{INI}$, $V_{REF}$, $V_{TFT}$, and $V_{EL}$ in the pixel circuit example in FIG. 2, which are supplied to each pixel circuit respectively via an initialization power line 71, a reference voltage power line 68, an EL anode power line 69, and an EL cathode power line 70.

The data line drive circuit 5 drives each source signal line (data line 76 in FIG. 2) in the display panel 6, based on the first control signal generated by the control unit 2. In more detail, the data line drive circuit 5 outputs a source signal to each pixel circuit based on the video signal and the horizontal synchronization signal.

The scan line drive circuit 3 drives each scan line in the display panel 6, based on the second control signal generated by the control unit 2. In more detail, the scan line drive circuit 3 outputs a scan signal, a ref signal, an enable signal, and an init signal to each pixel circuit at least on a display line basis, based on the vertical synchronization signal and the horizontal synchronization signal. These scan signal, ref signal, enable signal, and init signal are output respectively to a scan line 72, a ref line 73, an enable line 75, and an init line 74 in the pixel circuit example in FIG. 2, and are each used to control on/off of the connected switch.

The display device 1 has the structure described above.

The display device 1 may include, for example, a central processing unit (CPU), a storage medium such as read only memory (ROM) storing a control program, working memory such as random access memory (RAM), and a communication circuit, although not illustrated. For example, a display data signal S1 is generated by the CPU executing the control program.

The structure of the pixel circuit illustrated as an example in FIG. 2 is described next.

A pixel circuit 60 in FIG. 2 is one pixel included in the display panel 6, and has a function of emitting the amount of light corresponding to the data signal (data signal voltage) supplied via the data line 76 (data line).

The pixel circuit 60 is an example of one of the display pixels (light emitting pixels) arranged in a matrix. The pixel circuit 60 includes a drive transistor 61, a switch 62, a switch 63, a switch 64, an enable switch 65, an EL element 66, and a capacitance element 67. The pixel circuit 60 also includes the data line 76 (data line), the reference voltage power line 68 ($V_{REF}$), the EL anode power line 69 ($V_{TFT}$), the EL cathode power line 70 ($V_{EL}$), and the initialization power line 71 ($V_{INI}$).

The data line 76 is an example of the signal line (source signal line) for supplying the data signal voltage.

The reference voltage power line 68 ($V_{REF}$) is a power line for supplying the reference voltage $V_{REF}$ that defines the voltage value of a first electrode of the capacitance element 67. The EL anode power line 69 ($V_{TFT}$) is a high-voltage power line for determining the potential of the drain electrode of the drive transistor 61. The EL cathode power line 70 ($V_{EL}$) is a low-voltage power line connected to a second electrode (cathode) of the EL element 66. The initialization power line 71 ($V_{INI}$) is a power line for initializing the source-gate voltage of the drive transistor 61, i.e. the voltage of the capacitance element 67.

The EL element 66 is an example of one of the light emitting elements arranged in a matrix. The EL element 66 has a light emission period in which the EL element 66 emits light with a drive current passing through it, and a non-light emission period in which the EL element 66 does not emit light with no drive current passing through it. In detail, the EL element 66 emits the amount of light corresponding to the amount of current supplied from the drive transistor 61. The EL element 66 is, for example, an organic EL element. The EL element 66 has its cathode (second electrode) connected to the EL cathode power line 70, and its anode (first electrode) connected to the source (source electrode) of the drive transistor 61. The voltage supplied to the EL cathode power line 70 here is $V_{EL}$, which is 0 V as an example.

The drive transistor 61 is a voltage drive element for controlling the amount of current supplied to the EL element 66, and causes the EL element 66 to emit light by passing a current (drive current) through the EL element 66. In detail, the drive transistor 61 has its gate electrode connected to the first electrode of the capacitance element 67, and its source electrode connected to the second electrode of the capacitance element 67 and the anode of the EL element 66.

In the case where the switch 63 is off (nonconducting state) so that the reference voltage power line 68 and the first electrode of the capacitance element 67 are not in conduction with each other and the enable switch 65 is on (conducting state) so that the EL anode power line 69 and the drain electrode are in conduction with each other, the drive transistor 61 passes the drive current corresponding to the data signal voltage through the EL element 66, to cause the EL element 66 to emit light. The voltage supplied to the EL anode power line 69 here is $V_{TFT}$, which is 20 V as an example. Thus, the drive transistor 61 converts the data signal voltage (data signal) supplied to the gate electrode into the signal current corresponding to the data signal voltage (data signal), and supplies the signal current to the EL element 66.

In the case where the switch 63 is off (nonconducting state) so that the reference voltage power line 68 and the first electrode of the capacitance element 67 are not in conduction with each other and the enable switch 65 is off (nonconducting state) so that the EL anode power line 69 and the drain electrode are not in conduction with each other, the drive transistor 61 passes no drive current through the EL element 66, to cause the EL element 66 not to emit light. This operation will be described in detail later.

The capacitance element 67 is an example of a storage capacitor for holding a voltage, and holds the voltage that determines the amount of current passed by the drive transistor 61. In detail, the capacitance element 67 has its second electrode (electrode on the node B side) connected between the source (on the EL cathode power line 70 side) of the drive transistor 61 and the anode (first electrode) of the EL element 66, and its first electrode (electrode on the node A side) connected to the gate of the drive transistor 61. The first electrode of the capacitance element 67 is also connected to the reference voltage power line 68 ($V_{REF}$) via the switch 63.

The switch 62 switches the state between the data line 76 (signal line) for supplying the data signal voltage and the first electrode of the capacitance element 67, between conducting and nonconducting. In detail, the switch 62 is a switching transistor that has one of its drain and source terminals connected to the data line 76, the other one of its drain and source terminals connected to the first electrode of the capacitance element 67, and its gate connected to the scan line 72 as a scan line. In other words, the switch 62 has a function of writing the data signal voltage (data signal) corresponding to the video signal voltage (video signal) supplied via the data line 76, to the capacitance element 67.

The switch 63 switches the state between the reference voltage power line 68 for supplying the reference voltage $V_{REF}$ and the first electrode of the capacitance element 67, between conducting and nonconducting. In detail, the switch 63 is a switching transistor that has one of its drain and source terminals connected to the reference voltage power line 68 ($V_{REF}$), the other one of its drain and source terminals connected to the first electrode of the capacitance element 67, and its gate connected to the ref line 73. In other words, the switch 63 has a function of supplying the reference voltage ($V_{REF}$) to the first electrode of the capacitance element 67 (the gate of the drive transistor 61).

The switch 64 switches the state between the second electrode of the capacitance element 67 and the initialization power line 71, between conducting and nonconducting. In detail, the switch 64 is a switching transistor that has one of its drain and source terminals connected to the initialization power line 71 ($V_{INI}$), the other one of its drain and source terminals connected to the second electrode of the capacitance element 67, and its gate connected to the init line 74. In other words, the switch 64 has a function of supplying the initialization voltage ($V_{INI}$) to the second electrode of the capacitance element 67 (the source of the drive transistor 61).

The enable switch 65 switches the state between the EL anode power line 69 and the drain electrode of the drive transistor 61, between conducting and nonconducting. In detail, the enable switch 65 is a switching transistor that has one of its drain and source terminals connected to the EL anode power line 69 ($V_{TFT}$), the other one of its drain and source terminals connected to the drain electrode of the drive transistor 61, and its gate connected to the enable line 75.

The pixel circuit 60 has the structure described above.

Although the following description assumes that the switches 62 to 64 and the enable switch 65 in the pixel circuit 60 are n-type TFTs, this is not a limitation. The switches 62 to 64 and the enable switch 65 may be p-type TFTs. Alternatively, the switches 62 to 64 and the enable switch 65 may be a combination of n-type and p-type TFTs. Any signal line connected to the gate of a p-type TFT has the below-mentioned voltage level inverted.

The potential difference between the voltage $V_{REF}$ of the reference voltage power line 68 and the voltage $V_{INI}$ of the initialization power line 71 is set to be larger than the maximum threshold voltage of the drive transistor 61.

Moreover, the voltage $V_{REF}$ of the reference voltage power line 68 and the voltage $V_{INI}$ of the initialization power line 71 are set as follows so that no current flows through the EL element 66.

(voltage $V_{INI}$)<(voltage $V_{EL}$)+(the forward current threshold voltage of the EL element 66)

(the voltage $V_{REF}$ of the reference voltage power line 68)<(voltage $V_{EL}$)+(the forward current threshold voltage of the EL element 66)+(the threshold voltage of the drive transistor 61).

Here, the voltage $V_{EL}$ is the voltage of the EL cathode power line 70 as mentioned above.

[1-2. Operation of Display Device]

Figure 3:
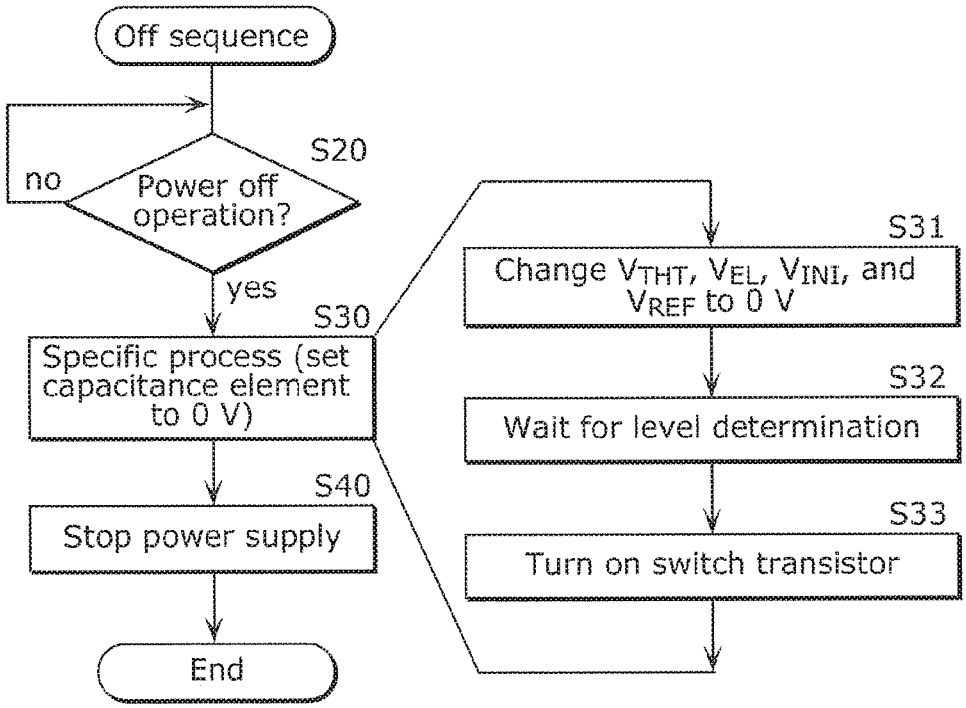
FIG. 3 is a flowchart illustrating the power off method of the display device according to the embodiment.
Figure 4:
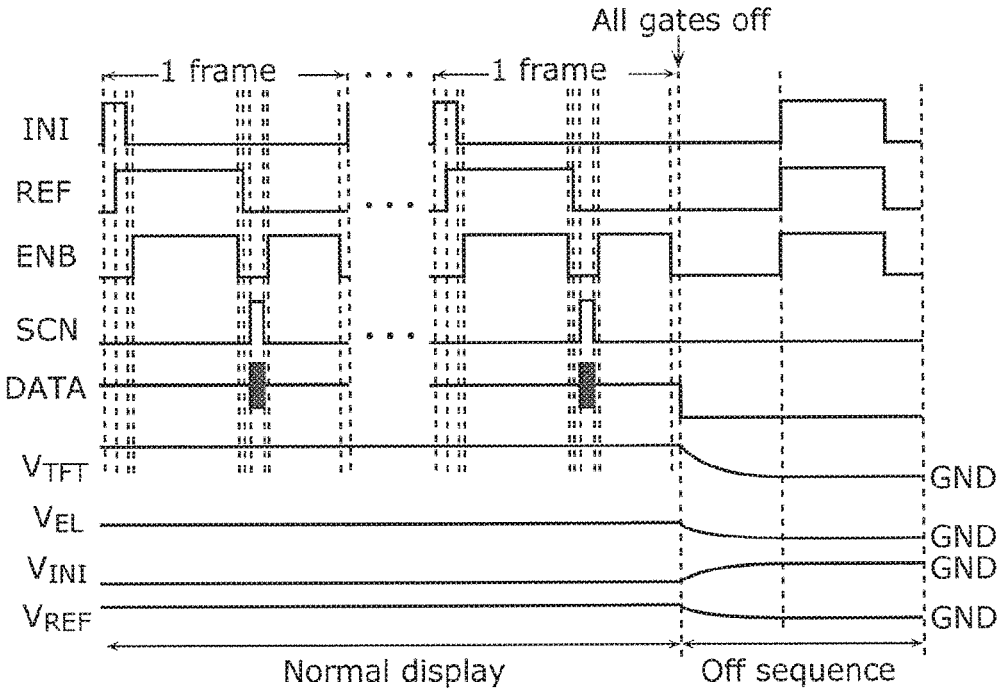
FIG. 4 is a timing chart illustrating the normal display operation and the off sequence performed immediately before power off of the display device according to the embodiment.

The following describes the operation in the example of the structure of the display device illustrated in FIGS. 1 and 2, with reference to FIGS. 3 and 4.

FIG. 3 is a flowchart illustrating the power off method of the display device according to the embodiment. FIG. 4 is a timing chart illustrating the normal display operation and the off sequence performed immediately before power off of the display device according to the embodiment.

The off sequence operation (power off method) is described first, before the description of the normal display operation.

As illustrated in FIG. 3, the control unit 2 detects a power off operation on the display device 1 (Step S20). Examples of the power off operation include: the user pressing a power button on a remote control; the user pressing a power button on the body of the display device 1; the arrival of an off time of an off timer set by the user; a lapse of a time of a non-operation duration measurement timer set by the user; and a decrease in AC power voltage when power fails. When the power off operation is detected, the operation of the control unit 2 shifts from normal display control to off sequence control, as illustrated in FIG. 4.

When the power off operation is detected, the control unit 2 performs a specific process, namely, setting the same potential in the two electrodes of the capacitance element 67 in order to suppress electrical stress on the drive transistor 61 in each of the plurality of pixel circuits 60 (Step S30). As a result of setting the voltage between the source or drain and gate of the drive transistor to 0 V, electrical stress can be suppressed.

Further, the power unit 4 stops power supply to the display panel 6, the scan line drive circuit 3, and the data line drive circuit 5 immediately after the voltage is set, under control by the control unit 2 (Step S40). This puts the display device 1 in a power off state.

For example, Steps S31 to S33 may be performed to set the voltage in Step S30.

When the power off operation is detected, the control unit 2 first performs a control of setting a gate signal to the pixel circuit 60 to low level and turns off the switch, for all rows of the display panel 6. The gate signal mentioned here may be all of the scan signal, ref signal, enable signal (ENB), and init signal (INI), and is not limited as long as at least the enable signal is included. Hence, at least the enable switch 65 is turned off so that current is no longer supplied to the EL element 66.

The control unit 2 then controls the power unit 4 to set the potentials of the reference voltage power line 68, EL anode power line 69, EL cathode power line 70, and initialization power line 71 to 0 V. The voltages of these power lines are thus changed to ground level (i.e. 0 V) (Step S31). Since these power lines have large wiring capacitance (stray capacitance), they change to 0 V more gently than other signal lines, as illustrated in the off sequence interval in FIG. 4.

The control unit 2 accordingly provides a wait time until the voltage levels of the power lines are determined at 0 V (Step S32). The wait time is set depending on the drive capability of the power unit 4 and the wiring capacitance mentioned above, and is several mS as an example.

After the levels of the power lines are determined at 0 V (after the elapse of the wait time), the control unit 2 sets the ref line 73, the init line 74, and the enable line 75 to high level and, after a predetermined time, sets the ref line 73, the init line 74, and the enable line 75 to low level, for all pixel circuits (Step S33). Accordingly, the switches 63, 64, and 65 are on for the predetermined time and are in conduction with the power lines of 0 V, so that both electrodes of the capacitance element 67 are set to 0 V. The predetermined time may be set depending on the capacitance of the capacitance element 67, the parasitic capacitance of the EL element 66, the above-mentioned wiring capacitance, and the drive capability of the power unit 4. The predetermined time may be substantially equal to the wait time. Thus, at least the potential of the capacitance element 67 is stabilized at 0 V, before proceeding to the next Step S40.

According to the sequence in FIG. 4, 0 V can be set in the capacitance elements 67 of all pixel circuits simultaneously. Electrical stress on the drive transistor 61 after power off can be suppressed in this way.

Although the above describes an example of performing the operation in Step S33 on all pixels of all rows simultaneously, the operation may be performed sequentially on the rows by row scanning.

Figure 7:
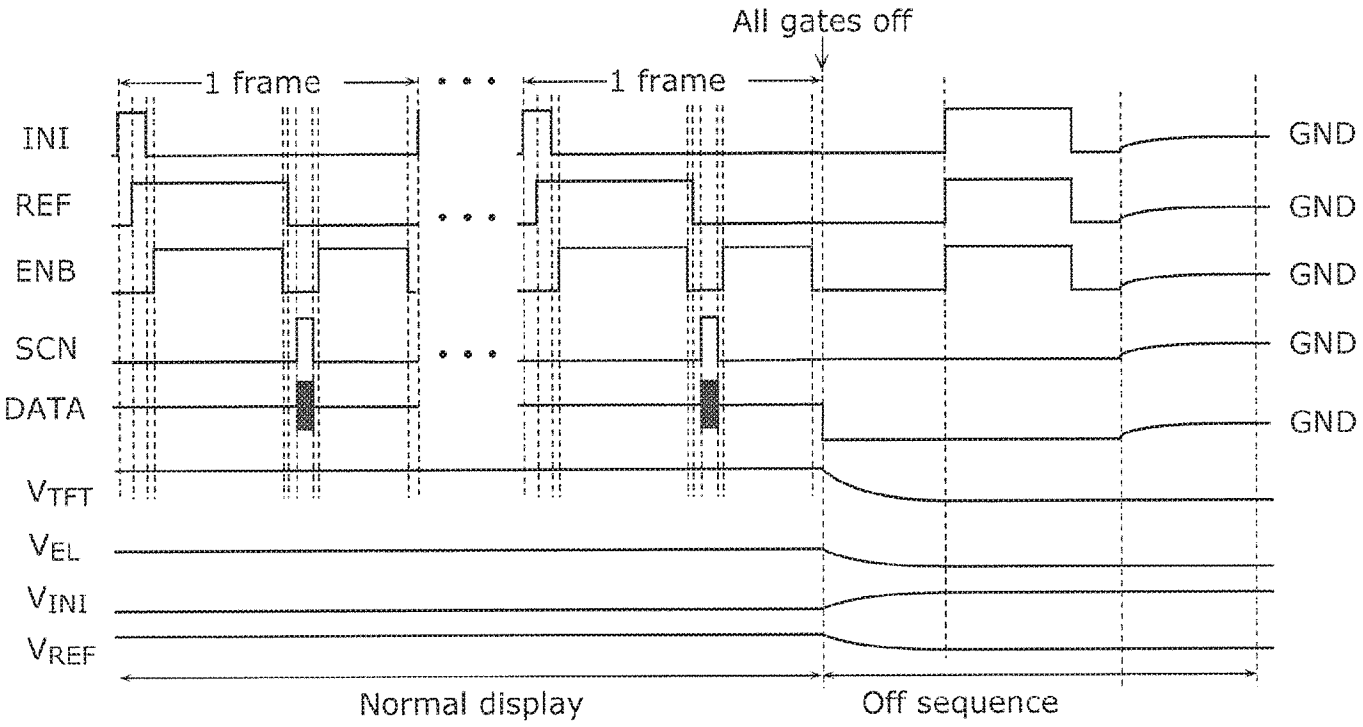
FIG. 7 is a timing chart illustrating another example of the timings of the normal display operation according to the embodiment.

As illustrated in FIG. 7, by turning off the power after the signal levels of the ref line 73, init line 74, enable line 75, and scan line 72 are set to 0 V, the gate-source voltage of each of the transistors 62 to 65 connected to these signal lines to perform switch operation can also be set to 0 V. This suppresses electrical stress, and prevents the threshold voltage shift.

[1-3. Advantageous Effects]

As described above, one aspect of a power off method of a display device according to the disclosure is a power off method of a display device that includes a display panel having a plurality of pixel circuits arranged in a matrix, each of the plurality of pixel circuits including: a light emitting element that emits light according to an amount of current supplied; a drive transistor that supplies the current to the light emitting element; and a capacitance element that is connected to a gate of the drive transistor and holds a voltage representing luminance, the power off method of a display device including: detecting a power off operation on the display device; setting, when the power off operation is detected, a same potential in one electrode and an other electrode of the capacitance element in each of the plurality of pixel circuits; and stopping power supply to the display panel immediately after the same potential is set.

With this method, the threshold voltage shift of the drive transistor in the period during which the power of the display device is off can be prevented.

Moreover, in the setting, a ground potential may be set in the plurality of pixel circuits as the same potential.

With this method, by setting the gate-source voltage of the drive transistor to 0 V during power off, electrical stress can be suppressed to prevent the threshold voltage shift.

Moreover, in the setting, the same potential may be set in the plurality of pixel circuits simultaneously.

With this method, the capacitance elements in all pixel circuits are set in a batch, thus reducing the time to stop power supply.

Moreover, each of the plurality of pixel circuits may further include: a first switch transistor (the switch 63) connected to the one electrode of the capacitance element; a first wire (the reference voltage power line 68) connected to the one electrode of the capacitance element 67 via the first switch transistor (the switch 63); a second switch transistor (the switch 64) connected to the other electrode of the capacitance element 67; and a second wire (the initialization power line 71) connected to the other electrode of the capacitance element 67 via the second switch transistor (the switch 64), and in the setting: 0 V may be supplied to the first wire (the reference voltage power line 68) and the second wire (the initialization power line 71); and the first switch transistor (the switch 63) and the second switch transistor (the switch 64) may be turned on after potentials of the first wire and the second wire reach 0 V.

With this method, 0 V can be set in the capacitance elements 67 of all pixel circuits simultaneously.

One aspect of a display device according to the disclosure is a display device including a display panel having a plurality of pixel circuits arranged in a matrix, each of the plurality of pixel circuits including: a light emitting element that emits light according to an amount of current supplied; a drive transistor that supplies the current to the light emitting element; and a capacitance element that is connected to a gate of the drive transistor and holds a voltage representing luminance, the display device including: a control unit that sets, when a power off operation is detected, a same potential in one electrode and an other electrode of the capacitance element in each of the plurality of pixel circuits; and a power unit that stops power supply to the display panel immediately after a specific process is completed.

With this structure, the threshold voltage shift of the drive transistor in the period during which the power of the display device is off can be prevented.

[Modifications]

Although the embodiment has been described above to illustrate the disclosed technique, the disclosed technique is not limited to such. Changes, replacements, additions, omissions, etc. may be made to the embodiment as appropriate, and structural elements described in the embodiment may be combined as a new embodiment.

Figure 5:
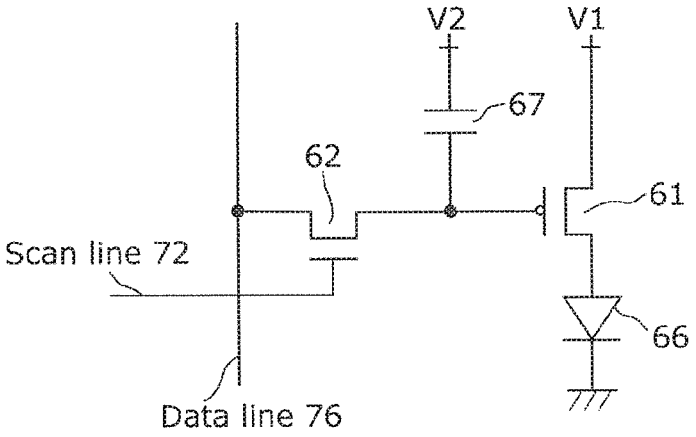
FIG. 5 is a circuit diagram illustrating an example of a display pixel according to a modification of the embodiment.

FIG. 5 is a circuit diagram illustrating an example of a display pixel according to a modification of the embodiment. The pixel circuit in FIG. 5 includes the drive transistor 61, the switch 62, the EL element 66, and the capacitance element 67, and has a simpler structure than the pixel circuit in FIG. 2.

The drive transistor 61 in FIG. 5 is not an n-type TFT but a p-type TFT, and has its drain connected to a power line of a voltage V1.

The capacitance element 67 has one electrode connected to a power line of a voltage V2. The voltage V1 may be the same as the voltage V2.

The switch 62 has one of its source and drain connected to the data line 76, the other one of its source and drain connected to the other electrode of the capacitance element 67, and its gate connected to the scan line 72. With this structure, in the off sequence, first the power line of the voltage V1, the power line of the voltage V2, and the potential of the data line 76 are set to 0 V, and then the switches 61 and 62 are turned on.

As a result, the potentials of the two electrodes of the capacitance element 67 are 0 V, and the potential of the parasitic capacitance of the EL element 66 is 0 V, too. The drain-gate voltage and source-gate voltage of the drive transistor 61 are accordingly 0 V. In this state, the power unit 4 stops power supply to the display panel 6.

Thus, the pixel circuit 60 is not limited to the circuit example in FIG. 2, and may be the circuit example in FIG. 5. In the circuit example in FIG. 5, a switch may be added between the power line of the voltage V1 and the drive transistor 61, with the enable line 75 being connected to the gate of the switch. In the circuit example in FIG. 5, a switch may be added between the power line of the voltage V2 and the drive transistor 61, with the ref line 73 being connected to the gate of the switch. In the circuit example in FIG. 5, the initialization power line 71 may be connected to the anode of the EL element 66 via a switch, with the init line 74 being connected to the gate of the switch. The drive transistor 61 may be n-type or p-type as illustrated in FIG. 2.

Another Embodiment

Another embodiment of the disclosure is described below, with reference to FIG. 6. The structures of the display device and pixel circuit in this embodiment are the same as those in FIGS. 1 and 2. The power off method and the timing chart in this embodiment are also the same as those in FIGS. 3 and 4. The display device 1 in this embodiment supports 4K television, and has effective pixels of at least 3840 horizontal pixels×2160 vertical pixels.

An example of the drive timings of the normal display in this embodiment is described first.

Figure 6:
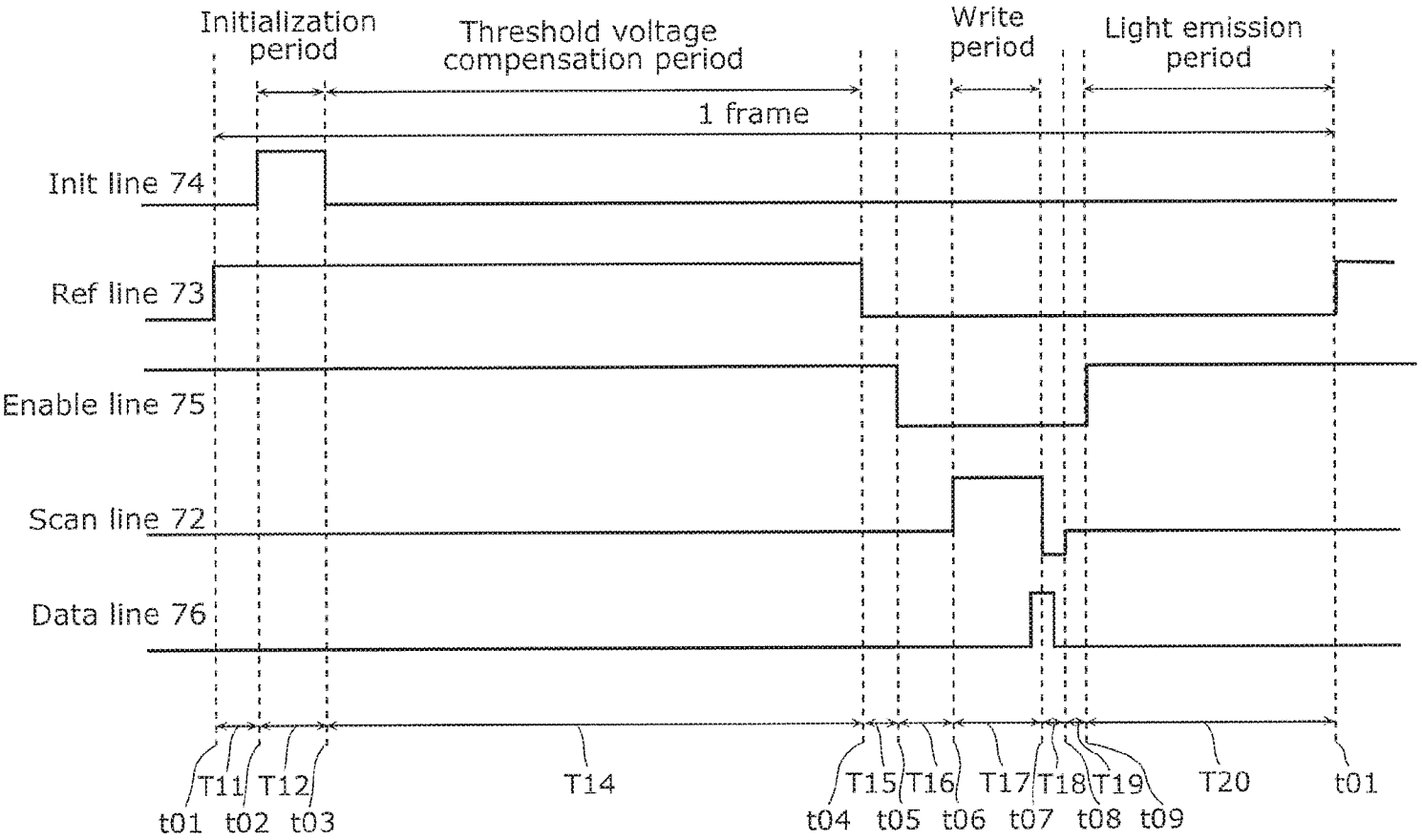
FIG. 6 is a timing chart illustrating an example of the detailed timings of the normal display operation according to an embodiment.

FIG. 6 is a timing chart illustrating an example of the detailed timings of the normal display operation according to this embodiment. It is assumed in FIG. 6 that one frame period (i.e. the period 1V of the vertical synchronization signal) corresponds to 2250 horizontal periods (i.e. 2250 times the period of the horizontal synchronization signal). In FIG. 6, the respective operations in the initialization period, the threshold voltage compensation period, the write period, and the light emission period are performed in this order.

At time t01, the ref line 73 transitions from low to high. This rise causes the EL element 66 not to emit light.

The non-light emission period of the EL element 66 can be adjusted by adjusting the width of period T11.

At time t02, the init line 74 transitions from low to high. This rise starts the initialization period.

Period T12 is the initialization period. A period for sufficient discharge of the parasitic capacitance of node B (the capacitance of the EL element 66) to the init line 74 is provided in the initialization period. The initialization period is also a period for discharging the parasitic capacitance of node A to determine the potential. This period is defined by a trade-off between the charge to the parasitic capacitance and the current flowing through the drive transistor 61. At the end of period T12, the initial voltage necessary for the flow of drain current in order to perform threshold voltage compensation on the drive transistor 61 is held in the capacitance element 67.

At time t03, the init line 74 transitions from high to low. This starts the threshold voltage compensation period.

Period T14 is the threshold voltage compensation period. The threshold voltage compensation is an operation of setting, in the capacitance element 67 in each pixel circuit, the voltage equivalent to the threshold voltage of the corresponding drive transistor 61.

At time t04, the switch 63 changes from on to off at the falling edge of the ref line 73, and thus the threshold voltage compensation period ends. The potential difference between nodes A and B (the gate-source voltage of the drive transistor 61) at this point is the potential difference equivalent to the threshold of the drive transistor 61, and this voltage is held in the capacitance element 67.

Period T15 is a period for determining the gate potential in the row, given that the gate potential of the drive transistor 61 varies when the switch 63 changes from on to off at time t04. This period is called a REF transition period.

At time t05, the enable line 75 transitions from high to low, to turn off the enable switch 65. This stops power supply to the drive transistor 61.

Period T16 is a period for establishing the same potential of the EL anode power line 69 ($V_{TFT}$) in all pixels in the row after the enable switch 65 is turned off.

Period T17 is a write period, in which the pulse fall of the scan line 72 is overdriven in detail, at time t07, the pulse falls to a potential lower than the normal low level. This is intended to shorten the fall time and promptly determine the write to the capacitance element 67, as the pulse of the scan line 72 actually has a considerably rounded waveform.

Period T18 is an overdrive period.

Period T19 is a period for determining the gate potential in the row, given that the gate potential of the drive transistor 61 varies when the switch 62 changes from on to off at time t07. This period is called a SCN transition period.

At time t09, the enable line 75 transitions from low to high. This starts the light emission period.

Period T20 is the light emission period. This period is, for example, about 95% of one frame period (2250 H). In other words, light can be emitted for a period which is about 95% of one frame period.

The example of the drive timings of the normal display illustrated in FIG. 6 is suitable for a display device with a large number of pixels such as 4K television, where light emission is possible for most (about 95%) of one frame period.

Moreover, since there is no transistor switch for controlling whether or not to electrically connect the gate and source of the drive transistor 61 included in each pixel, the problem of a decrease in bootstrap efficiency (a decrease in threshold voltage compensation ratio of the drive transistor) due to the gate capacitance of the transistor during normal display can be avoided.

Although the embodiment has been described above to illustrate the disclosed technique, the disclosed technique is not limited to such. Changes, replacements, additions, omissions, etc. may be made to the embodiment as appropriate.

For example, the material of the semiconductor layers in the drive transistors and switching transistors used in the light emitting pixels according to the disclosure may be, but not limited to, an oxide semiconductor material such as IGZO (In—Ga—Zn—O). A transistor whose semiconductor layer is made of an oxide semiconductor such as IGZO has low leakage current. Moreover, in the case where a transistor whose semiconductor layer is made of an oxide semiconductor such as IGZO is used as a switch, a positive threshold voltage can be used, with it being possible to suppress leakage current from the gate of the drive transistor.

Although organic EL elements are used as light emitting elements in each of the foregoing embodiments, any type of light emitting elements may be used as long as the amount of light emission changes according to current.

The display device such as an organic EL display device described above may be used as a flat panel display, and is applicable to all kinds of electronics having display devices, such as television sets, personal computers, and mobile phones.

INDUSTRIAL APPLICABILITY

The disclosure may be used in display devices, in particular the display devices of television sets and the like.

REFERENCE SIGNS LIST

1 Display device
2 Control unit
3 Scan line drive circuit
4 Power unit
5 Data line drive circuit
6 Display panel

60 Pixel circuit
61 Drive transistor
62, 63, 64 Switch
65 Enable switch
66 EL element
67 Capacitance element
68 Reference voltage power line
69 EL anode power line
70 EL cathode power line
71 Initialization power line
72 Scan line
73 Ref line
74 Init line
75 Enable line
76 Data fine

What is claimed is:

1. A light emitting display panel comprising:

a plurality of pixel circuits arranged in a matrix, each of the plurality of pixel circuits including:

a light emitting element; and a capacitor that is connected to a gate of a drive transistor and the light emitting element, the capacitor having a first electrode and a second electrode;

wherein each of the plurality of pixel circuits further including:

the drive transistor connected to the light emitting element;

a first switch transistor connected to the first electrode of the capacitor;

a first wire connected to the first electrode of the capacitor via the first switch transistor;

a second switch transistor connected to the second electrode of the capacitor and the light emitting element;

a second wire connected to the second electrode of the capacitor via the second switch transistor;

a third switch transistor connected to the first electrode of the capacitor; and a first node to which only the following four elements are connected:

the first electrode of the capacitor, the gate of the drive transistor, a drain or a source of the first switch transistor, and a drain or a source of the third switch transistor, wherein the drive transistor is connected to an enable switch and an anode of the light emitting element, wherein a voltage of the first wire and a voltage of the second wire are the same during a power off operation, wherein the first wire is electrically connected to a data line which is electrically connected to the first node via the first switch transistor, and wherein the second wire is electrically connected to an initialization power line which is electrically connected to a second node via the second switch transistor.

2. The light emitting display panel according to claim 1, wherein the first switch transistor and the second switch transistor are turned on.

3. The light emitting display panel according to claim 1, wherein the drive transistor comprises an oxide semiconductor material.

4. The light emitting display panel according to claim 3, wherein each of the first switch transistor and the second switch transistor comprises an oxide semiconductor material.

5. The light emitting display panel according to claim 3, wherein the semiconductor material comprises IGZO (In—Ga—Zn—O).

6. The light emitting display device according to claim 1, wherein each of the driving transistor, the first switch transistor, and the second switch transistor is an n-type TFT (thin film transistor).

7. The light emitting display panel according to claim 1, wherein, in the second node, only the following four elements are connected: the second electrode of the capacitor, a drain or a source of the drive transistor, a drain or a source of the second switch transistor, and an anode of the light emitting element.

8. A light emitting display panel comprising:

a plurality of pixel circuits arranged in a matrix, each of the plurality of pixel circuits including:

a light emitting element; and a capacitance element that is connected to a gate of a drive transistor and the light emitting element, the capacitance element having a first electrode and a second electrode;

wherein each of the plurality of pixel circuits further includes:

the drive transistor connected to the light emitting element;

a first switch transistor connected to the first electrode of the capacitance element;

a first wire connected to the first electrode of the capacitance element via the first switch transistor;

a second switch transistor connected to the second electrode of the capacitance element and the light emitting element;

a second wire connected to the second electrode of the capacitance element via the second switch transistor;

a third switch transistor connected to the first electrode of the capacitance element; and a first node to which only the following four elements are connected:

the first electrode of the capacitance element, the gate of the drive transistor, a drain or a source of the first switch transistor, and a drain or a source of the third switch transistor, wherein the drive transistor is connected to an enable switch and an anode of the light emitting element, wherein a voltage of the first wire and a voltage of the second wire are the same during a non-light emission period, wherein the first wire is electrically connected to a data line which is electrically connected to the first node via the first switch transistor, and wherein the second wire is electrically connected to an initialization power line which is electrically connected to a second node via the second switch transistor.

9. The light emitting display panel according to claim 8, wherein, in the second node, only the following four elements are connected: the second electrode of the capacitance element, a drain or a source of the drive transistor, a drain or a source of the second switch transistor, and an anode of the light emitting element.

* * * * *